US010529164B2

(12) United States Patent
Kuroki et al.

(10) Patent No.: US 10,529,164 B2
(45) Date of Patent: Jan. 7, 2020

(54) PAPER SHEET PROCESSING DEVICE AND CONTROL METHOD THEREFOR

(71) Applicant: GLORY LTD., Himeji-shi, Hyogo (JP)

(72) Inventors: Ryoma Kuroki, Hyogo (JP); Keisuke Nada, Hyogo (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 29 days.

(21) Appl. No.: 15/760,989

(22) PCT Filed: Sep. 6, 2016

(86) PCT No.: PCT/JP2016/004062
§ 371 (c)(1),
(2) Date: Mar. 16, 2018

(87) PCT Pub. No.: WO2017/047043
PCT Pub. Date: Mar. 23, 2017

(65) Prior Publication Data

US 2018/0261032 A1 Sep. 13, 2018

(30) Foreign Application Priority Data

Sep. 17, 2015 (JP) ..... 2015-183676
Sep. 6, 2016 (WO) ..... PCT/JP2016/004062

(51) Int. Cl.
*G07D 11/25* (2019.01)
*G07D 11/14* (2019.01)
(Continued)

(52) U.S. Cl.
CPC ..... *G07D 11/25* (2019.01); *G07D 7/164* (2013.01); *G07D 11/14* (2019.01); *G07D 11/17* (2019.01);
(Continued)

(58) Field of Classification Search
CPC ..... G07D 11/14; G07D 11/16; G07D 11/17; G07D 11/23; G07D 11/25; G07D 11/50; G07D 7/164; G07D 7/181
(Continued)

(56) References Cited

U.S. PATENT DOCUMENTS 4,166,540 A * 9/1979 Marshall ..... G06Q 30/02 209/555
2010/0108576 A1* 5/2010 Wada ..... B65H 29/58 209/534
(Continued)

FOREIGN PATENT DOCUMENTS

EP 2249318 A1 * 11/2010 ..... B65H 39/115
EP 2 669 869 A2 12/2013
(Continued)

*Primary Examiner* — Terrell H Matthews
(74) *Attorney, Agent, or Firm* — Renner Kenner Greive Bobak Taylor and Weber; Tim Hodgkiss; Edward Greive

(57) ABSTRACT

A paper sheet handling apparatus includes a stacking unit which allows paper sheets transported by a transport unit to be stacked therein in alignment with faces of an adjacent pair of the paper sheets being in contact with each other. A recognition unit recognizes which of a face or back of each of the paper sheets transported faces up, and how each of the paper sheets is oriented. A controller classifies the paper sheets into a plurality of types different in thickness distribution based on the result of recognition, manages the number of paper sheets of each type stacked in the stacking unit, and makes a determination whether to permit the stacking of the paper sheets in the stacking unit based on the type of the paper sheets recognized by the recognition unit, and the number of paper sheets of each type that have been stacked in the stacking unit.

16 Claims, 8 Drawing Sheets

(51) Int. Cl.

| | |
|---|---|
| ***G07D 11/17*** | (2019.01) |
| ***G07D 7/164*** | (2016.01) |
| ***G07D 11/23*** | (2019.01) |
| ***G07D 11/50*** | (2019.01) |
| *G07D 11/13* | (2019.01) |
| *G07D 11/125* | (2019.01) |
| *G07D 7/181* | (2016.01) |

(52) U.S. Cl.
CPC ..... *G07D 11/23* (2019.01); *G07D 11/50* (2019.01); *G07D 7/181* (2017.05); *G07D 11/125* (2019.01); *G07D 11/13* (2019.01); *G07D 2207/00* (2013.01); *G07D 2211/00* (2013.01)

(58) Field of Classification Search
USPC ..... 209/534
See application file for complete search history.

(56) References Cited

U.S. PATENT DOCUMENTS

2011/0004337 A1* 1/2011 Doi ..... B65H 39/115 700/223
2011/0133395 A1* 6/2011 Taniguchi ..... B65H 29/006 271/225
2012/0155710 A1* 6/2012 Kotani ..... G07D 11/50 382/103
2012/0242031 A1* 9/2012 Taniguchi ..... B65H 5/26 271/10.13
2014/0174995 A1* 6/2014 Ang ..... B07C 3/00 209/546
2018/0047238 A1* 2/2018 Ueoka ..... B65H 7/06

FOREIGN PATENT DOCUMENTS

| | | | | |
|---|---|---|---|---|
| JP | 5-73757 | A | | 3/1993 |
| JP | 2002-56438 | A | | 2/2002 |
| JP | 2002056438 | A | * | 2/2002 |
| JP | 2003-296795 | A | | 10/2003 |
| JP | 2005-242685 | A | | 9/2005 |
| JP | 2005242685 | A | * | 9/2005 |
| JP | 3856441 | B2 | | 9/2006 |
| JP | 2008-84049 | A | | 4/2008 |
| JP | 2014-215623 | A | | 11/2014 |

* cited by examiner

COUNT VALUE

| TYPE | TY1 | TY2 |
|---|---|---|
| NUMBER | N1 | N2 |

TY1 : STYLE A, STYLE C
TY2 : STYLE B, STYLE D

STACKING INFORMATION

| ORDER | TYPE |
|---|---|
| 135 | TY1 |
| 134 | TY1 |
| 133 | TY2 |
| : | : |
| 3 | TY1 |
| 2 | TY2 |
| 1 | TY1 |

COUNT VALUE

| TYPE | TY1 | TY2 | TY3 | TY4 |
|---|---|---|---|---|
| NUMBER | N1 | N2 | N3 | N4 |

TY1 : STYLE A
TY2 : STYLE B
TY3 : STYLE C
TY4 : STYLE D

STACKING INFORMATION

| ORDER | TYPE |
|---|---|
| 135 | TY3 |
| 134 | TY1 |
| 133 | TY4 |
| : | : |
| 3 | TY1 |
| 2 | TY2 |
| 1 | TY3 |

PAPER SHEET PROCESSING DEVICE AND CONTROL METHOD THEREFOR

TECHNICAL FIELD

The present disclosure relates to a paper sheet handling apparatus and a method for controlling the apparatus.

BACKGROUND ART

Patent Document 1 describes a circulating banknote handling apparatus including a cartridge housing banknotes. This banknote handling apparatus is configured to handle banknotes each having an anti-counterfeit identifier such as a security thread or a hologram. A banknote having an identifier does not have a uniform thickness, i.e., is thick at a portion, and thin at the other portion. If such banknotes are oriented and stacked in the same manner, the identifiers overlap with each other at the same position. Thus, a top surface of the stacked banknotes is inclined. This may increase the possibility of stacking failure or feeding failure.

To cope with such a problem, the banknote handling apparatus of Patent Document 1 includes an inverting unit branched from some midpoint of a banknote transport path. If a target banknote is oriented in the same manner as the preceding banknote of the same denomination, the inverting unit inverts the target banknote before stacking it in the cartridge. This configuration prevents the stacking of the identifiers predetermined number of times or more continuously at the same position.

CITATION LIST

Patent Documents

[Patent Document 1] Japanese Patent No. 3856441

SUMMARY OF THE INVENTION

Technical Problem

The banknote handling apparatus of Patent Document 1 requires the inverting unit provided at some midpoint of the banknote transport path, which inevitably increases the size of the banknote handling apparatus. Further, the destination of the banknotes needs to be switched during the process of transporting the banknotes, which complicates the control of transport of the banknotes. In addition, the inversion is performed in accordance with the number of banknotes continuously transported in the same orientation. Thus, the control is not always performed suitably in accordance with the actual state of the banknotes stacked in the stacking unit. For example, it is quite possible that the inversion which is unnecessary in view of the actual stacking state is performed.

In view of the foregoing background, it is therefore an object of the present disclosure to allow a paper sheet handling apparatus including a stacking unit, which is configured to stack paper sheets in alignment, with surfaces of an adjacent pair of the paper sheets being in contact with each other, to suitably control the state of the paper sheets stacked in the stacking unit, without upsizing the apparatus, or making the control of the transport complicated.

Solution to the Problem

The present disclosure is directed to a paper sheet handling apparatus including: an intake unit through which paper sheets are taken in one by one; a transport unit which transports the paper sheets taken in through the intake unit; a recognition unit which recognizes which of a face or back of each of the paper sheets being transported by the transport unit faces up and how each of the paper sheets being transported by the transport unit is oriented; and a stacking unit in which the paper sheets transported by the transport unit are stacked in alignment, with surfaces of an adjacent pair of the paper sheets being in contact with each other.

The paper sheet handling apparatus includes a controller which controls transport of the paper sheets to the stacking unit. The controller is configured to: classify the paper sheets into a plurality of types that are different in thickness distribution based on a result of recognition by the recognition unit as to which of a face or back of the paper sheet faces up, and how the paper sheet is oriented; manage the number of paper sheets of each type stacked in the stacking unit; and make a determination whether to permit the stacking of the paper sheets in the stacking unit based on the type to which the paper sheets recognized by the recognition unit belong, and the number of paper sheets of each type that have been stacked in the stacking unit.

In this configuration, the controller, which controls the transport of the paper sheets to the stacking unit, classifies the paper sheets into a plurality of types that are different in thickness distribution based on the result of the recognition unit as to which of the face or back of each of the paper sheets faces up and how each of the paper sheets is oriented, and manages the number of the paper sheets of each type stacked in the stacking unit. Then, a determination whether to permit the stacking of the paper sheets in the stacking unit is made based on the type to which the paper sheets belong and the number of paper sheets of each type that have been stacked in the stacking unit. As a result, the controller can suitably control the transport of the paper sheets based on the actual state of the paper sheets stacked in the stacking unit. This can maintain the paper sheets in the stacking unit in a suitably stacked state. In addition, this neither causes upsizing of the apparatus nor leads to complicated control of the transport.

The controller may obtain an index value representing a state of the paper sheets stacked in the stacking unit based on the number of paper sheets of each type stacked in the stacking unit, and make the determination based on the index value.

In this configuration, an index value representing the state of the paper sheets stacked in the stacking unit is obtained based on the number of paper sheets of each type that have been stacked in the stacking unit, and a determination whether to permit the stacking of the paper sheets in the stacking unit is made based on the index value. Thus, the transport of the paper sheets can be controlled with accuracy based on the actual state of the paper sheets stacked in the stacking unit.

The index value may be, for example, a value representing how unstably the paper sheets are stacked in the stacking unit. Alternatively, the index value may represent the inclination of the stacked paper sheets with respect to a plane perpendicular to the stacking direction of the paper sheets. Specifically, when the paper sheets are aligned vertically, the index value may represent the inclination of the uppermost paper sheet with respect to a horizontal plane. Alternatively, when the paper sheets are aligned horizontally, the index value may represent the inclination of the paper sheet located farthest from a support plane on which the paper sheets are stacked with respect to a vertical plane.

The controller may classify the paper sheets into a first type and a second type, which are the plurality of types, and use, as the index value, a difference between the number of paper sheets of the first type stacked in the stacking unit and the number of paper sheets of the second type stacked in the stacking unit.

In this configuration, the paper sheets are classified into the first and second types, and the difference between the numbers of the paper sheets of the first and second types is used as an index value representing the state of the paper sheets stacked in the stacking unit. Thus, the transport of the paper sheets can be easily controlled with accuracy based on the actual state of the paper sheets stacked in the stacking unit.

If the difference is equal to or greater than a predetermined value, the controller does not permit the paper sheets of the first type to be stacked in the stacking unit when a larger number of the paper sheets of the first type have been stacked in the stacking unit than the paper sheets of the second type.

In this configuration, if the difference between the numbers of paper sheets of the first and second types is equal to or greater than the predetermined value, the paper sheets of one of the types which have been stacked more than the paper sheets of the other type in the stacking unit are not permitted to be stacked in the stacking unit. That is, the control is performed to reduce the difference between the numbers of the paper sheets of the first and second types.

In the paper sheet handling apparatus, the stacking unit may include a plurality of stacking units, and the controller may select, among the plurality of stacking units, at least one stacking unit which pen its the stacking of the paper sheets therein based on the index value, and selects, if there are two or more stacking units which permit the stacking of the paper sheets therein, one of the two or more stacking units which allows the index value to approach a target value when the paper sheets transported by the transport unit are stacked therein.

In this configuration, the controller selects, among the plurality of stacking units, at least one stacking unit which permits the stacking of the paper sheets therein based on the index value representing the state of the paper sheets stacked in the stacking unit. If there are two or more stacking units which permit the stacking of the paper sheets therein, the controller selects one of the stacking units which allows the index value to approach a target value when the paper sheets are stacked therein. For example, if the index value is a value representing how unstably the paper sheets are stacked in each of the stacking units, one stacking unit is selected such that the paper sheets stacked therein become less unstable. Alternatively, for example, if the index value is a value representing how much the stacked paper sheets are inclined with respect to a plane perpendicular to the stacking direction of the paper sheets, one stacking unit is selected such that the paper sheets stacked therein become less inclined. As a result, the state of the paper sheets stacked in each of the stacking units can be maintained to be more suitable.

The paper sheet handling apparatus may further include a second stacking unit in which the paper sheets transported by the transport unit are stacked in alignment, with surfaces of an adjacent pair of the paper sheets being in contact with each other. The controller may control the transport unit so that paper sheets which are not permitted to be stacked in the stacking unit are stacked in the second stacking unit.

In this configuration, the paper sheets which are not permitted to be stacked in the stacking unit are stacked in the second stacking unit.

The paper sheet handling apparatus may further include a discharge unit which receives paper sheets that are not accepted by the paper sheet handling apparatus. The controller may control the transport unit so that paper sheets which are not permitted to be stacked in the stacking unit are transported to the discharge unit.

In this configuration, the paper sheets which are not permitted to be stacked in the stacking unit are transported to the discharge unit which receives paper sheets that are not accepted by the paper sheet handling apparatus.

The paper sheet handling apparatus may include a keeping unit which keeps the paper sheets. The controller may control the transport unit so that paper sheets which are not permitted to be stacked in the stacking unit are transported to the keeping unit.

In this configuration, the paper sheets which are not permitted to be stacked in the stacking unit are stacked in the keeping unit which keeps the paper sheets.

The stacking unit may include a feeding unit, and the keeping unit may include no feeding unit.

The paper sheet handling apparatus may further include: a discharge unit which receives paper sheets that are not accepted by the paper sheet handling apparatus; and a keeping unit which keeps the paper sheets. The controller may control the transport unit so that paper sheets which are not permitted to be stacked in the stacking unit are transported to the discharge unit or the keeping unit, and is able to switch a destination of the paper sheets between the discharge unit and the keeping unit.

In this configuration, the paper sheets which are not permitted to be stacked in the stacking unit are transported to the discharge unit which receives paper sheets that are not accepted by the paper sheet handling apparatus, or the keeping unit which keeps the paper sheets. The destination of the paper sheets may be switched between the discharge unit and the keeping unit.

The controller may instruct the intake unit to stop the taking of the paper sheets if the stacking of the paper sheets in the stacking unit is not permitted, or if the stacking of the paper sheets in the stacking unit is not permitted and a history of the determination satisfies a predetermined condition.

In this configuration, if the paper sheets are not permitted to be stacked in the stacking unit, the taking of the paper sheets is stopped. This can save a user from needless work.

The controller may output to the outside of the paper sheet handling apparatus, via an information output unit, information which encourages a user to turn the paper sheets to be taken in through the intake unit over or change an orientation of the paper sheets if the stacking of the paper sheets in the stacking unit is not permitted, or if the stacking of the paper sheets in the stacking unit is not permitted and a history of the determination satisfies a predetermined condition.

In this configuration, the controller outputs, to the outside of the paper sheet handling apparatus, information which encourages a user to turn the paper sheets to be taken in through the intake unit over or change an orientation of the paper sheets if, for example, the stacking of the paper sheets in the stacking unit is not permitted. Receiving the information, the user turns the paper sheets over, or changes the orientation of the paper sheets, and then places the paper sheets again.

The paper sheet handling apparatus may further include a memory unit which stores stacking information indicating a stacking order of the paper sheets stacked in the stacking unit, and to which one of the plurality of types each of the paper sheets belongs.

In this configuration, the number of paper sheets of each type stacked in the stacking unit can be easily managed based on the stacking information stored in the memory unit.

The stacking unit includes a feeding unit which feeds the paper sheets, and the controller updates the stacking information as the paper sheets are fed from the stacking unit.

In this configuration, the stacking information is updated based on the actual state of the paper sheets stacked in the stacking unit.

It is further disclosed herein a method for controlling transport of paper sheets to a stacking unit of a paper sheet handling apparatus, the stacking unit being configured to stack paper sheets in alignment, with surfaces of an adjacent pair of the paper sheets being in contact with each other. The method includes: allowing a transport unit to transport the paper sheets taken in the paper sheet handling apparatus; allowing a recognition unit to recognize which of a face or back of each of the paper sheets being transported by the transport unit faces up, and how each of the paper sheets being transported by the transport unit is oriented; and allowing a controller to: classify the paper sheets into a plurality of types that are different in thickness distribution based on a result of recognition by the recognition unit as to which of the face or back of the paper sheet faces up, and how the paper sheet is oriented; manage the number of paper sheets of each type stacked in the stacking unit; and make a determination whether to permit the stacking of the paper sheets in the stacking unit based on the type to which the paper sheets recognized by the recognition unit belong, and the number of paper sheets of each type that have been stacked in the stacking unit.

In this configuration, the controller classifies the paper sheets that have been taken in the paper sheet handling apparatus into a plurality of types that are different in thickness distribution based on the result of recognition by the recognition unit as to which of the face or back of each of the paper sheets faces up and how each of the paper sheets is oriented, and manages the paper sheets of each type stacked in the stacking unit. Then, a determination whether to permit the stacking of the paper sheets in the stacking unit is made based on the type to which the paper sheets belong and the number of paper sheets of each type that have been stacked in the stacking unit. As a result, the controller can suitably control the transport of the paper sheets based on the actual state of the paper sheets stacked in the stacking unit. This can maintain the paper sheets in the stacking unit in a suitably stacked state. In addition, this neither causes upsizing of the apparatus nor leads to complicated control of the transport.

Advantages of the Invention

The present disclosure allows a paper sheet handling apparatus to suitably control the transport of paper sheets based on an actual state of the paper sheets stacked in a stacking unit. This can maintain the paper sheets in the stacking unit in a suitably stacked state.

DESCRIPTION OF EMBODIMENTS

Embodiments of a paper sheet handling apparatus will be described in detail below with reference to the drawings. The present disclosure will be described below taking a banknote handling apparatus as an example of the paper sheet handling apparatus.

(General Configuration of Banknote Handling Apparatus)

Figure 1:
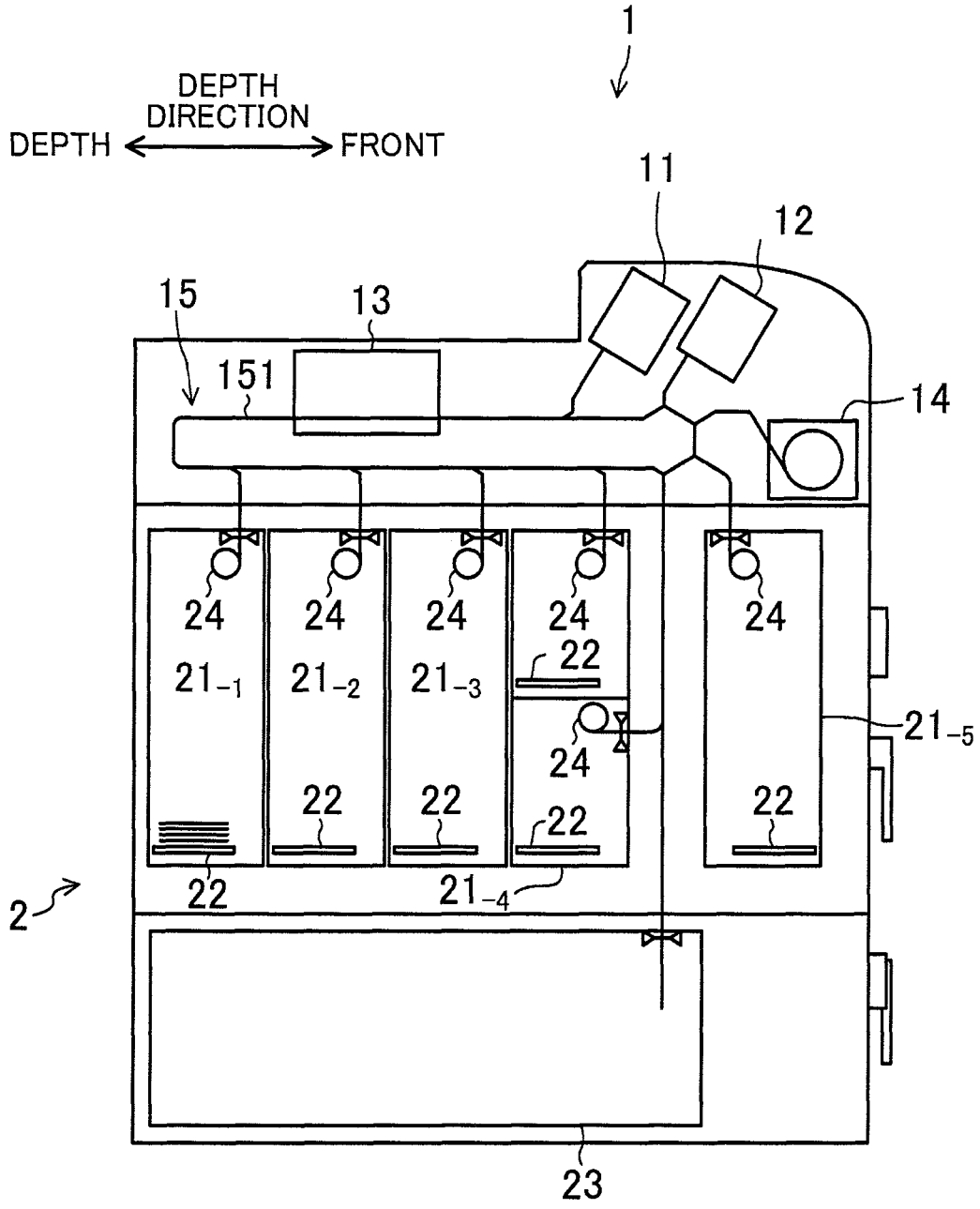
FIG. 1 conceptually illustrates a configuration of a paper sheet handling apparatus.

FIG. 1 conceptually illustrates a configuration of a banknote handling apparatus 1. The banknote handling apparatus 1 is used in branches of a bank or any other financial institutions. The banknote handling apparatus 1 shown in FIG. 1 is a banknote depositing and dispensing machine which performs depositing and dispensing of banknotes. The banknote handling apparatus 1 is a so-called "circulating" banknote depositing and dispensing machine. Specifically, banknotes dispensed from the banknote handling apparatus 1 in a dispensing process include banknotes that have been stored in the apparatus in a depositing process. Note that the banknote handling apparatus 1 is not limited to the circulating banknote depositing and dispensing machine. The banknote handling apparatus 1 is not limited to a banknote depositing and dispensing machine.

The banknote handling apparatus 1 includes a depositing unit 11, a dispensing unit 12, a recognition unit 13, an escrow unit 14, a transport unit 15, and a storage unit 2 for storing the banknotes.

Although not shown in detail, the depositing unit 11 has an inlet through which the banknotes are placed. The inlet opens at a top surface of the banknote handling apparatus 1. For example, in a depositing process, the banknotes are placed in the inlet. The inlet holds two or more banknotes at a time. The depositing unit 11 is an example of an intake unit through which paper sheets are taken in one by one.

The dispensing unit 12 has an outlet which opens at the top surface of the banknote handling apparatus 1. For example, in a dispensing process, the banknotes come to the outlet. The outlet holds two or more banknotes at a time. The dispensing unit 12 is an example of a discharge unit which receives paper sheets that are not accepted by the paper sheet handling apparatus.

The recognition unit 13 is provided at some midpoint of a transport path 151 through which the banknotes are transported. The recognition unit 13 is configured to recognize at least a denomination of each of the banknotes being transported through the transport path 151, and whether each of the banknotes is genuine or not. The recognition unit 13 may also be configured to recognize whether the banknotes are fit or unfit. The recognition unit 13 includes various sensors for sensing features of the banknotes, such as an image sensor, an infrared sensor, a UV sensor, and a magnetic sensor. The recognition unit 13 obtains the features of the banknotes using these sensors, and recognizes the banknotes.

The escrow unit 14 is a storage unit which temporarily stores banknotes rejected in the dispensing process, for example. The escrow unit 14 also functions as a storage unit which temporarily stores banknotes taken in the depositing process, for example. The escrow unit 14 is a winding storage unit.

In an example shown in FIG. 1, the storage unit 2 includes five banknote storing cassettes, namely, first to fifth banknote storing cassettes 21-1 to 21-5, and a collection cassette 23. In the following description, reference numeral "21" will collectively indicate the first to fifth banknote storing cassettes. When the first to fifth banknote storing cassettes need to be distinguished from each other, reference numerals "21-1," "21-2," "21-3," "21-4," and "21-5" will be given to them. The first to fifth banknote storing cassettes 21-1 to 21-5, and the collection cassette 23 are detachably attached to the banknote handling apparatus 1.

The first to fourth banknote storing cassettes 21-1 to 21-4 are sequentially arranged side by side in a depth direction of the banknote handling apparatus 1, i.e., from the depth (left of the paper of FIG. 1) to the front (right of the paper) of the banknote handling apparatus 1. The fifth banknote storing cassette 21-5 is arranged forward of the fourth banknote storing cassette 21-4 with a vertically extending connection path interposed between the fourth and fifth banknote storing cassettes.

The banknote storing cassette 21 stores the banknotes aligned in the vertical direction, with surfaces of an adjacent pair of the banknotes being in contact with each other. That is, the banknote storing cassette 21 stores the banknotes stacked in the vertical direction. The banknote storing cassette 21 is an example of a stacking unit in which the banknotes are stacked in alignment, with surfaces of an adjacent pair of the banknotes being in contact with each other. The banknote storing cassette 21 is configured to store banknotes sent therein, and to be able to feed the stored banknotes outside.

In the banknote storing cassette 21, a support 22 which supports the banknotes in an aligned state, and rollers 24 arranged adjacent to a port of the cassette through which the banknotes pass are provided. The banknotes transported to the banknote storing cassette 21 are stacked on a support plane of the support 22. The rollers 24, which are an example of a feeding unit, allow the banknotes transported in the banknote storing cassette 21 to be stacked on the support plane of the support 22, and feed the banknotes stored in the banknote storing cassette 21 one by one out of the cassette.

The interior of the fourth banknote storing cassette 21-4 is horizontally divided in two rooms as shown in FIG. 1. In each of the upper and lower rooms of the fourth banknote storing cassette 21-4, the support 22 and the rollers 24 are provided.

The collection cassette 23 is disposed below the first to fifth banknote storing cassettes 21-1 to 21-5. The collection cassette 23 is elongated in the depth direction of the banknote handling apparatus 1. Although not shown in detail, the collection cassette 23 is configured to store banknotes aligned in a horizontal direction, with surfaces of an adjacent pair of the banknotes being in contact with each other. That is, the banknotes in the collection cassette 23 stand upright, and are arranged in the depth direction of the banknote handling apparatus 1. The collection cassette 23 has no feeding unit, and thus, cannot feed the stored banknotes outside. The collection cassette 23 stores, for example, banknotes that were not able to be stored in the banknote storing cassettes 21 (e.g., overflowed banknotes), among the banknotes placed in the inlet in the depositing process. The collection cassette 23 is an example of a keeping unit which keeps paper sheets.

The transport unit 15 includes a looped transport path 151. Each of the depositing unit 11, the dispensing unit 12, the escrow unit 14, the first to fifth banknote storing cassettes 21-1 to 21-5, and the collection cassette 23 is connected to the transport path 151 via a connection path. Banknotes on the transport path 151 are selectively transported to the depositing unit 12, the escrow unit 14, the first to fifth banknote storing cassettes 21-1 to 21-5, or the collection cassette 23.

In the depositing process, the banknote handling apparatus 1 operates in the following manner. Specifically, banknotes to be deposited are placed in the inlet. The depositing unit 11 feeds the banknotes in the inlet one by one. The transport unit 15 transports the banknotes to the recognition unit 13. The recognition unit 13 recognizes the banknotes. The transport unit 15 transports the banknotes to the escrow unit 14. The escrow unit 14 temporarily stores the deposited banknotes. The transport unit 15 transports the banknotes from the escrow unit 14 to a predetermined banknote storing cassette 21 or the collection cassette 23 based on the recognition results. The transport unit 15 may transport the banknotes to the dispensing unit 12. The depositing process ends when the banknotes in the inlet are all fed.

In the dispensing process, the banknote handling apparatus 1 operates in the following manner. Specifically, the banknotes to be dispensed to the outlet are fed from the predetermined banknote storing cassette 21. The transport unit 15 transports the banknotes to the recognition unit 13. The recognition unit 13 recognizes the banknotes. The transport unit 15 dispenses fit banknotes to the outlet. The transport unit 15 transports rejected banknotes to the escrow unit 14. The escrow unit 14 stores the rejected banknotes. The dispensing process ends when a designated amount of banknotes is dispensed to the outlet. The transport unit 15 also transports the rejected banknotes stored in the escrow unit 14 to a predetermined banknote storing cassette 21 or the collection cassette 23.

(Examples of Banknotes to be Handled)

At least some of the banknotes to be handled by the banknote handling apparatus 1 have a projected portion on its surface. Each of such banknotes does not have a uniform thickness, i.e., is thick at a portion, and thin at the other portion. Specifically, as conceptually shown in FIG. 2, a banknote 100 is provided with Braille characters 101 indicating the denomination of the banknote at a predetermined position of the banknote 100. Alternatively, although not shown in the drawings, a security thread or hologram for an anti-counterfeit purpose may be provided on part of the banknote 100. The security thread may extend from an end of the banknote 100 in a short edge direction to the other, or may be provided only on part of the banknote 100.

Figure 2:
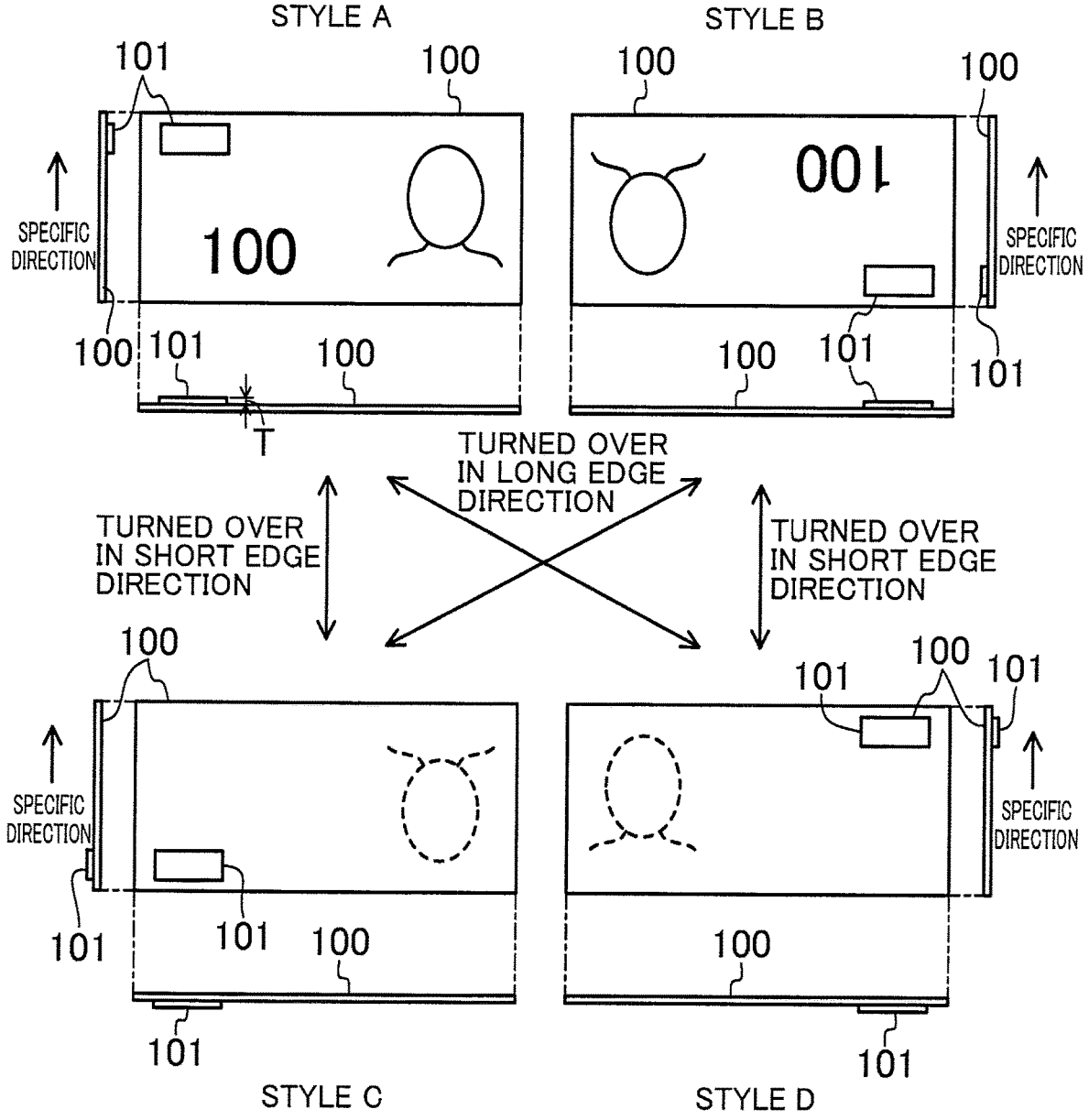
FIG. 2 illustrates the styles of a paper sheet.

In an example shown in FIG. 2, the Braille characters 101 are provided on an upper left corner of the front side of the banknote 100. The Braille characters 101 protrude from the surface with respect to the other part of the banknote. The banknote 100 may have no protrusions or depressions on a rear surface thereof. Alternatively, part of the banknote 100 provided with the Braille characters 101 may be depressed when viewed from the rear surface of the banknote 100. The banknote 100 having protrusions may be a so-called "composite material banknote" made of a composite material of a paper material and a polymer material. The composite material banknote may be partially protruded on both of the front and rear sides of the banknote.

The banknotes may be placed in the inlet in various styles. The "style" mentioned herein refers to which of a face or back of the banknote 100 faces up (will be hereinafter referred to as "face/back") and how the banknote 100 is oriented (will be hereinafter referred to as "orientation"). Thus, the banknotes 100 being transported on the transport path 151 are also not in the same style, and the banknotes 100 stacked in each banknote storing cassette 21 are also not in the same style. The style of the banknotes 100 being transported or stored in the banknote storing cassette 21 includes four different styles A to D as shown in FIG. 2 depending on the face/back and orientation of the banknote 100. The banknote 100 in the style A has its face faced up, and is oriented in a specific direction (the specific direction corresponds to a transport direction of the banknote 100 during transport). In the following description, the banknote oriented in the specific direction will be referred to as a "forward-oriented" banknote for the sake of convenience. The banknote 100 in the style B has its face faced up, and is oriented oppositely in the specific direction. In the following description, the banknote oriented oppositely in the specific direction will be referred to as a "backward-oriented" banknote for the sake of convenience. The banknote 100 in the style C has its face faced down, and is backward-oriented. The banknote 100 in the style D has its face faced down, and is forward-oriented.

The styles A and B are in such a relationship that inverting the banknote 100 in the style A upside down causes the banknote 100 to be in the style B. Likewise, the styles C and D are in such a relationship that inverting the banknote 100 in the style C upside down causes the banknote 100 to be in the style D. The styles A and C are in such a relationship that turning over the banknote 100 in the style A in the short edge direction causes the banknote 100 to be in the style C. Likewise, the styles B and D are in such a relationship that turning over the banknote 100 in the style B in the short edge direction causes the banknote 100 to be in the style D. The styles A and D are in such a relationship that turning over the banknote 100 in the style A in the long edge direction causes the banknote 100 to be in the style D. Likewise, the styles B and C are in such a relationship that turning over the banknote 100 in the style B in the long edge direction causes the banknote 100 to be in the style C.

Figure 3:
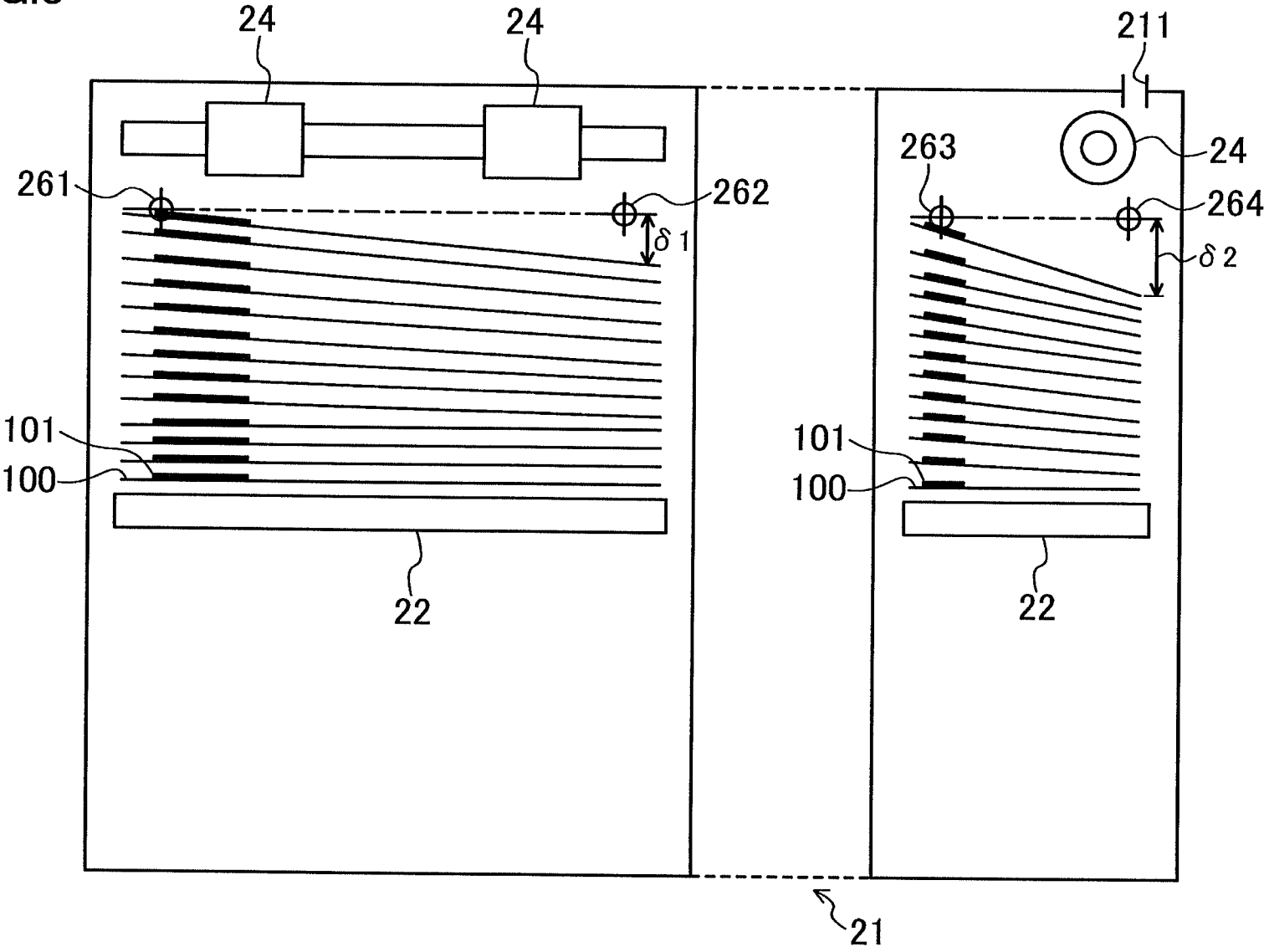
FIG. 3 illustrates a state where paper sheets in the same style are aligned.

If the banknotes 100 with the Braille characters 101 are stacked in the banknote storing cassette 21 so that the Braille characters 101 overlap one after another at the same position, the surfaces of the banknotes 100 are inclined as conceptually shown in FIG. 3, for example. In particular, the banknote located closest to a port 211, that is, the uppermost banknote 100 farthest from the support 22, has its surface greatly inclined with respect to a plane perpendicular to the direction of alignment. The inclination of the surface shown in FIG. 3 is represented by a height difference δ1 between one end of the banknote in the long edge direction and the other. Further, the inclination of the surface is also represented by a height difference δ2 between one end of the banknote in the short edge direction and the other. Controlling the level of the support 22 based on the detection results of sensors 261 to 264 provided within the banknote storing cassette 21 positions the uppermost banknote 100 at a predetermined level (that is, adjacent to the port 211) in the banknote storing cassette 21.

If a new banknote 100 were stacked on the inclined surface of the uppermost banknote 100, the new banknote 100 would slip and fall off the inclined uppermost banknote 100, which would lead to stacking failure.

Further, when the banknote 100 is fed from the banknote storing cassette 21, the rollers 24 rotate to feed the uppermost banknote 100 out of the banknote storing cassette 21. If the surface of the uppermost banknote 100 were inclined, pressure applied from the two rollers 24 to the banknote would be uneven to cause feeding failure, i.e., the banknote 100 would be fed in a direction deviated from the correct feeding direction, or the banknote 100 would not be fed.

To cope with such failures, according to the present embodiment, the transport of a new banknote to the banknote storing cassette 21 is controlled depending on the state of the banknotes stacked therein, so that the stacking failure and feeding failure of the banknote storing cassette 21 are avoided in advance. The control will be described in detail below.

(Control of Transport of Banknotes to Stacking Unit)

Figure 4:
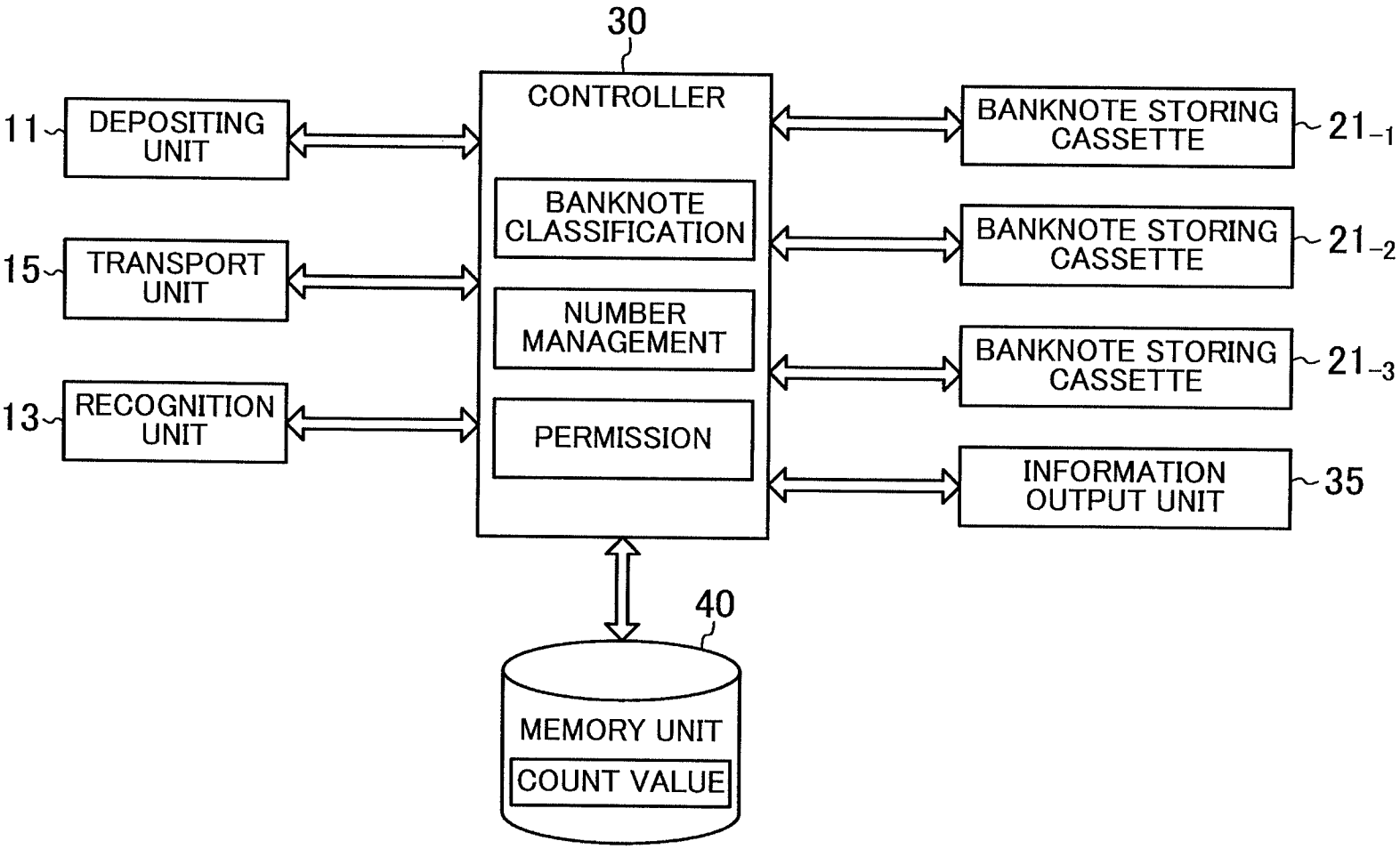
FIG. 4 is a block diagram illustrating a configuration for controlling the transport of the paper sheets based on the state of the paper sheets stacked in a stacking unit.

FIG. 4 is a block diagram illustrating a configuration for controlling the transport of a new banknote to the banknote storing cassette 21 depending on the state of banknotes stacked therein. A controller 30 controls the transport of banknotes taken in through the depositing unit 11 toward the banknote storing cassette 21 depending on the state of banknotes stacked in the banknote storing cassette 21. Among the banknote storing cassettes 21, the first to third banknote storing cassettes 21-1 to 21-3 are to be controlled. Hardware or software implements part or all of functions of the controller 30. For example, the controller 30 can be implemented by circuitry provided on a control board in the banknote handling apparatus 1, or a microcomputer for executing recorded programs. The controller 30 may be configured separately from, or integrally with, other controllers in the banknote handling apparatus 1.

The controller 30 classifies the banknotes transported by the transport unit 15 into a plurality of types that are different in thickness distribution based on the result of recognition by the recognition unit 13 as to which of the face or back of the banknote faces up, and how the banknote is oriented (banknote classification). In this example, the banknotes are classified into two types. Among the styles shown in FIG. 2, the banknotes in the styles A and C are classified into a first type TY1, and the banknotes in the styles B and D are classified into a second type TY2. The first and second types TY1 and TY2 are different in thickness distribution in the long edge direction. Specifically, each of the banknotes of the first type TY1 has a thick portion on the left in FIG. 2 due to the presence of the Braille characters 101, while each of the banknotes of the second type TY2 has a thick portion on the right in FIG. 2 due to the presence of the Braille characters 101. If the banknotes of the first and second types TY1 and TY2 are stacked in the banknote storing cassette 21 without greatly increasing the difference between their numbers, the inclination of the stacked banknotes in the long edge direction can be reduced.

The controller 30 manages the number of banknotes of each type classified and stacked in the banknote storing cassette 21 (number management). Specifically, in this example, the number of banknotes of the first type TY1 and the number of banknotes of the second type TY2 stacked in the banknote storing cassette 21 are managed. A memory unit 40 stores data of the numbers of banknotes managed.

Figure 5:
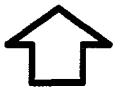
FIG. 5 is an example of data of the number of paper sheets stored in a memory unit.

FIG. 5 is an example of data of the numbers of banknotes stored in the memory unit 40. In the example shown in FIG. 5, the numbers of banknotes of different types stacked in the banknote storing cassette 21 are respectively managed as count values. The memory unit 40 stores, as the count values, the number N1 of the banknotes of the first type TY1 and the number N2 of the banknotes of the second type TY2. In this example, the count values with respect to the first to third banknote storing cassettes 21-1 to 21-3 are respectively managed.

The memory unit 40 further stores stacking information which indicates the stacking order of the banknotes stacked in the banknote storing cassette 21, and to which one of the first and second types TY1 and TY2 each banknote belongs. The count values are obtained from the stacking information. The controller 30 updates the stacking information stored in the memory unit 40 as the banknotes are stacked in the banknote storing cassette 21 and the banknotes are fed from the banknote storing cassette 21. The count values are updated as the stacking information is updated. In this way, the controller 30 manages at all times the number of banknotes of each type stacked in the banknote storing cassette 21. Note that only the count values can be managed without storing the stacking information.

The controller 30 makes a determination whether to permit the stacking of each of the banknotes transported by the transport unit 15 in the banknote storing cassette 21 based on to which one of the first and second types TY1 and TY2 the banknote belongs, and the count values stored in the memory unit 40, i.e., based on the number of banknotes of each of the first and second types TY1 and TY2 stacked in the banknote storing cassette 21 (permission).

Further, the controller 30 can output guidance, which will be described later, through an information output unit 35, such as a display or an audio output device provided for the banknote handling apparatus 1.

Figure 6:
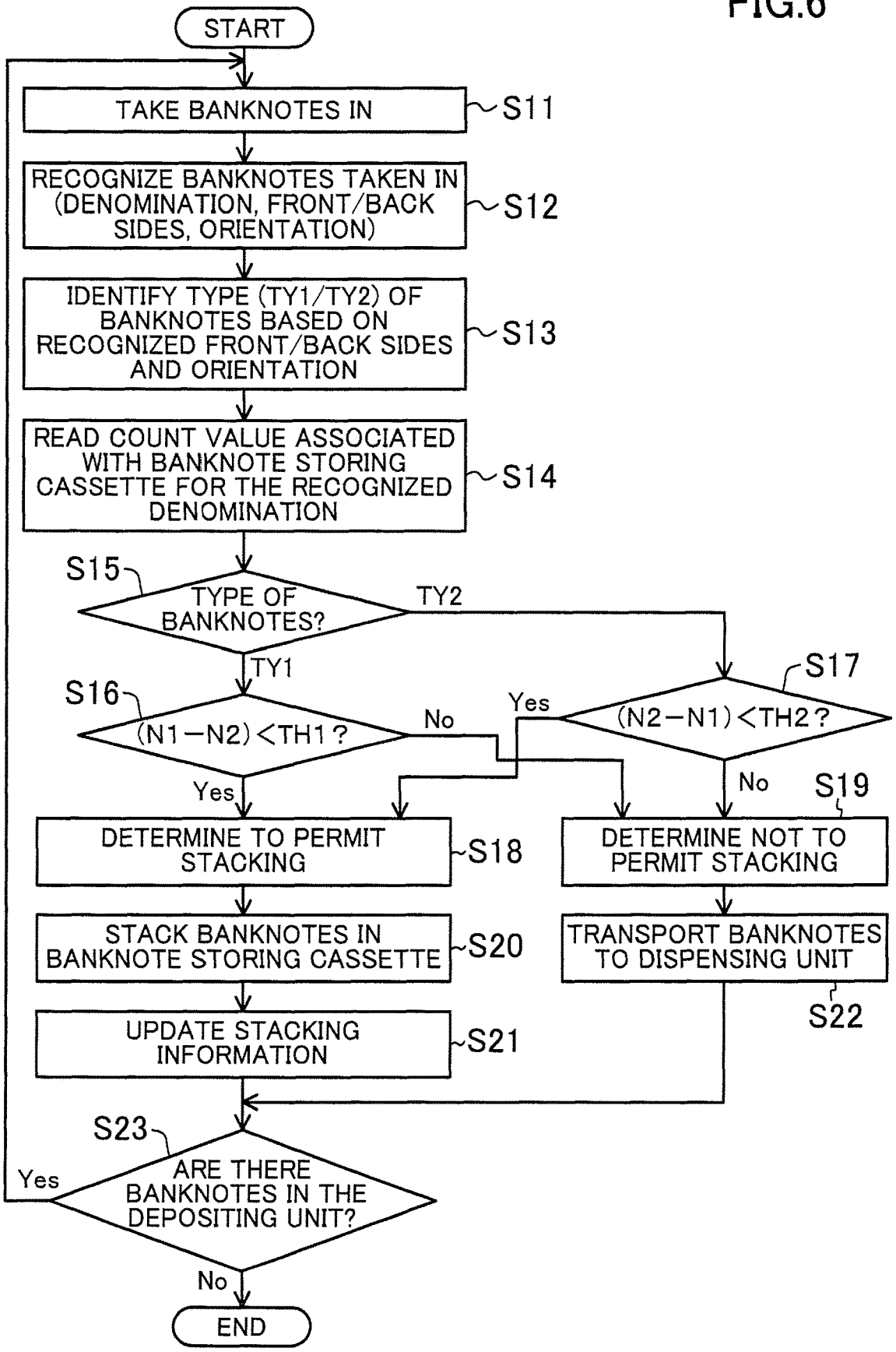
FIG. 6 is a flowchart illustrating an example of a process of controlling the transport of the paper sheets to a stacking unit.

FIG. 6 is a flowchart illustrating an example of a process of controlling the transport of the banknotes to the banknote storing cassette 21. Referring to FIG. 6, when a user places the banknotes on the depositing unit 11, the depositing unit 11 takes in the banknotes one by one (S11). Then, the transport unit 15 transports the banknotes thus taken in, and the recognition unit 13 recognizes the denomination, face/back, and orientation of each banknote (S12). Based on the face/back and orientation of the banknote thus recognized, the style of the banknote is classified into any of the styles A to D shown in FIG. 2.

Regarding the banknotes transported by the transport unit 15, the controller 30 receives the result of recognition sent from the recognition unit 13. Then, based on the face/back and orientation of the banknote thus recognized, the type of the banknote is identified (S13). As described above, the banknotes in the styles A and C are classified into the first type TY1, and the banknotes in the styles B and D are classified into the second type TY2. The controller 30 reads from the memory unit 40 the count value associated with the banknote storing cassette 21 (e.g., the banknote storing cassette 21-1) for the banknotes of the recognized denomination (S14). The count value includes the number of banknotes of the first type TY1 and the number of banknotes of the second type TY2, stacked in the banknote storing cassette 21-1.

The controller 30 determines whether to permit the stacking of the transported banknotes in the banknote storing cassette 21 (S15 to S19). If the banknotes are of the first type TY1, the determination is made based on the difference between the numbers (N1−N2) as an index value indicative of the state of the banknotes stacked. If (N1−N2) is considerably large, that is, if the number of banknotes of the first type TY1 is considerably larger than the number of banknotes of the second type TY2, the stacked banknotes are greatly inclined in the long edge direction, which means the banknotes stacked in the banknote storing cassette 21 are less stable. In such a state, further stacking the banknotes of the first type TY1 is not preferable because the banknotes already stacked become much less stable. Thus, if (N1−N2) is less than a threshold value TH1 (e.g., 100), it is determined to permit the stacking of the banknotes in the banknote storing cassette 21 (S18). On the other hand, if (N1−N2) is equal to or greater than the threshold value TH1, it is determined not to permit the stacking of the banknotes in the banknote storing cassette 21 (S19).

If the banknotes are of the second type TY2, the determination is made based on the difference between the numbers (N2−N1) as an index value indicative of the state of the banknotes stacked. If (N2−N1) is considerably large, that is, if the number of banknotes of the second type TY2 is considerably larger than the number of banknotes of the first type TY1, the stacked banknotes are greatly inclined in the long edge direction, which means the banknotes stacked in the banknote storing cassette 21 are less stable. In such a state, further stacking the banknotes of the second type TY2 is not preferable because the banknotes already stacked become much less stable. Thus, if (N2−N1) is less than a threshold value TH2 (e.g., 100), it is determined to permit the stacking of the banknotes in the banknote storing cassette 21 (S18). On the other hand, if (N2−N1) is equal to or greater than the threshold value TH2, it is determined not to permit the stacking of the banknotes in the banknote storing cassette 21 (S19). The threshold values TH1 and TH2 may be the same or different.

Determining to permit the stacking, the controller 30 instructs the transport unit 15 so that the banknotes are stacked in the banknote storing cassette 21 (S20). Then, the stacking information stored in the memory unit 40 is updated according to the type of the banknotes stacked (S21). The count values representing the numbers of banknotes of different types are also updated as the stacking information is updated. Determining not to permit the stacking, the controller 30 instructs the transport unit 15 not to transport the banknotes to the banknote storing cassette 21, but to the dispensing unit 12 which is an example of a discharge unit (S22). That is, the banknotes which are not permitted to be stacked are returned to a user. Thus, even if the stacking of the banknotes in the banknote storing cassette 21 is not permitted, there is no need to suspend the process.

The banknotes which are not permitted to be stacked in the banknote storing cassette 21 may be transported, not to the dispensing unit 12, but to the escrow unit 14, or the collection cassette 23 which is an example of a keeping unit. Alternatively, the controller 30 may control the transport unit 15 so that the banknotes that are not permitted to be stacked are stacked in, for example, the fifth banknote storing cassette 21-5 serving as a second stacking unit.

Further, the controller 30 may control the transport unit 15 so that the banknotes that are not permitted to be stacked in the banknote storing cassette 21 are transported to the dispensing unit 12 or the collection cassette 23, and may be able to switch the destination of the banknotes between the dispensing unit 12 and the collection cassette 23. The switching may suitably be carried out via, for example, an operation input unit such as a touch panel provided for the banknote handling apparatus 1.

In the above-described example, the controller 30, which controls the transport of the banknotes to the banknote storing cassette 21, classifies the banknotes taken in the banknote handling apparatus 1 into the first and second types TY1 and TY2 that are different in thickness distribution, based on the face/back and orientation of each of the banknotes recognized by the recognition unit 13. Then, the controller 30 manages the number of banknotes of each of the types TY1 and TY2 stacked in the banknote storing cassette 21. Based on to which one of the types the banknote belongs and the numbers of banknotes of the types TY1 and TY2 stacked in the banknote storing cassette 21, the controller 30 determines whether to permit the stacking of the banknotes in the banknote storing cassette 21. As a result, the controller 30 can suitably control the transport of the banknotes based on the actual state of the banknotes stacked in the banknote storing cassette 21. This can maintain the banknotes in the banknote storing cassette 21 in a suitably stacked state. In addition, this neither causes upsizing of the apparatus nor leads to complicated control of the transport.

From the number of banknotes of each of the types TY1 and TY2 stacked in the banknote storing cassette 21, a difference between the numbers is obtained as an index value representing the state of the banknotes stacked in the banknote storing cassette 21. Based on the difference, a determination whether to permit the stacking of the banknotes in the banknote storing cassette 21 is made. Thus, the transport of the banknotes can be controlled with accuracy based on the actual state of the banknotes stacked in the banknote storing cassette 21. Further, using the difference in number, the transport of the banknotes can easily be controlled based on the actual state of the banknotes stacked in the banknote storing cassette 21.

All the banknotes taken in the apparatus may sometimes have their faces or backs faced up, and may be oriented in the same direction. In such a case, if the banknotes thus taken in are not permitted to be stacked in the banknote storing cassette 21, most of the banknotes sequentially taken in are not permitted to be stacked in the banknote storing cassette 21. Thus, many banknotes are transported to the dispensing unit 12 and returned to a user. This may possibly cause the user to do useless work, e.g., he or she needs to place the banknotes again in the inlet not knowing why the banknotes are returned, and eventually receives the banknotes returned again. To reduce such a possibility, if the banknotes thus taken in are not permitted to be stacked in the banknote storing cassette 21, the controller 30 may instruct the depositing unit 11 to stop the taking of the banknotes. Further, the controller 30 may output to the outside of the apparatus 11, information (guidance) encouraging the user to turn over the banknotes to be taken in through the depositing unit 11, or change the orientation of the banknotes, via the information output unit 35. Receiving the guidance, the user can turn the banknotes over or change the orientation of the banknotes, before placing the banknotes again in the inlet. Such guidance may be output without instructing the depositing unit 11 to stop the taking of the banknotes.

Further, the controller 30 may stop the taking of the banknotes or output the guidance, not when the stacking of the banknotes thus taken in the banknote storing cassette 21 is not permitted, but when the stacking is not permitted and the history of the determination whether to permit the stacking or not satisfies a predetermined condition. In such a case, the history of the determination may suitably be stored in the memory unit 40, for example. The predetermined condition may include, for example: the stacking of banknotes of a single denomination has not been permitted predetermined number of times (e.g., 10 times) in a row; the total number of banknotes of the single denomination not permitted to be stacked has reached a predetermined number (e.g., 20 banknotes); the stacking of banknotes of every denomination handled by the apparatus 1 has not been permitted; the stacking of banknotes of every denomination has not been permitted predetermined number of times in a row; and the total number of banknotes of every denomination not permitted to be stacked has reached a predetermined number. Note that when to stop the taking of the banknotes and when to output the guidance may be controlled using different conditions.

<Examples of Other Processes>

(#1)

In the above-described example, the difference between the numbers of banknotes of the first and second types TY1 and TY2 has been used as an index value representing the state of the banknotes stacked in the banknote storing cassette 21. Alternatively, other indices may be used. For example, a ratio between the numbers of banknotes of the first and second types TY1 and TY2 may be used. Specifically, as the difference between the numbers of banknotes of the first and second types TY1 and TY2 increases, and the banknotes stacked in the banknote storing cassette 21 become less stable, the ratio between the numbers of banknotes becomes farther from 1. Therefore, the ratio between the numbers of banknotes can be used as an index value.

(#2)

The above-described example has aimed to reduce the inclination of the surface of the banknotes in the long edge direction of the banknotes stacked in the banknote storing cassette 21. Likewise, the inclination of the surface of the banknotes in the short edge direction of the banknotes can also be reduced. In such a case, among the four styles shown in FIG. 2, the banknotes in the styles A and D are classified into the first type TY1, and the banknotes in the styles B and C are classified into the second type TY2. The first and second types TY1 and TY2 are different in thickness distribution in the short edge direction. Specifically, each of the banknotes of the first type TY1 has a thick portion at the top in FIG. 2 due to the presence of the Braille characters 101, while each of the banknotes of the second type TY2 has a thick portion at the bottom in FIG. 2 due to the presence of the Braille characters 101. If the banknotes of the first and second types TY1 and TY2 are stacked in the banknote storing cassette 21 without greatly increasing the difference between their numbers, the inclination of the stacked banknotes in the short edge direction can be reduced.

(#3)

In the above-described example, the banknotes are classified into two types for management. However, the present disclosure is not limited to this example. For example, the four styles shown in FIG. 2 may be regarded as independently different types. That is, the banknotes in the styles A, B, C, and D may be respectively regarded and managed as banknotes of first to fourth types TY1, TY2, TY3, and TY4.

Figure 7:
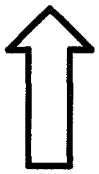
FIG. 7 is another example of data of the number of paper sheets stored in a memory unit.

FIG. 7 shows an example of data of the numbers of banknotes stored in the memory unit 40 in such a case. In the example shown in FIG. 7, the numbers of banknotes stacked in the banknote storing cassette 21 are respectively managed as count values. The memory unit 40 stores, as the count values, the number N1 of banknotes of the first type TY1, the number N2 of banknotes of the second type TY2, the number N3 of banknotes of the third type TY3, and the number N4 of banknotes of the fourth type TY4. The first type TY1 corresponds to the style A, the second type TY2 to the style B, the third type TY3 to the style C, and the fourth type TY4 to the style D. The memory unit 40 further stores stacking information which indicates the stacking order of banknotes stacked in the banknote storing cassette 21, and to which one of the first to fourth types TY1 to TY4 each banknote belongs. The count values are obtained from the stacking information.

In this case, to reduce the inclination of the banknotes in the long edge direction of the banknotes, for example, a difference or ratio between (N1+N3) and (N2+N4) may be used as an index value representing the state of the banknotes stacked. This can reduce the difference between the total number of banknotes in the styles A and C each having a thick left portion and the total number of banknotes in the styles B and D each having a thick right portion. Further, to reduce the inclination of the banknotes in the short edge direction of the banknotes, for example, a difference or ratio between (N1+N4) and (N2+N3) may be used as an index value representing the state of the banknotes stacked. This can reduce the difference between the total number of banknotes in the styles A and D each having a thick top portion and the total number of banknotes in the styles B and C each having a thick bottom portion.

For example, to reduce the inclination in both of the long and short edge directions of the banknotes stacked in a situation where the banknotes transported are of the first type TY1, it may be determined to permit the stacking of the banknotes in the banknote storing cassette 21 when the value ((N1+N3)−(N2+N4)) is less than a threshold value, and the value ((N1+N4)−(N2+N3)) is less than a threshold value (these two threshold values may be the same or different). In a situation where the banknotes transported are of the second type TY2, it may be determined to permit the stacking of the banknotes in the banknote storing cassette 21 when the value ((N2+N4)−(N1+N3)) is less than a threshold value, and the value ((N2+N3)−(N1+N4)) is less than a threshold value.

(#4)

In the above-described example, the stacking of the banknotes in the banknote storing cassette 21 is not permitted (banned) if the difference between the numbers of banknotes of the first and second types TY1 and TY2 is equal to or greater than the threshold value, i.e., if the index value deviates from the allowable range. However, the present disclosure is not limited to this example. For example, if the index value exceeds the allowable range, the priority of the stacking of the banknotes in the banknote storing cassette 21 may be lowered. This makes it possible to execute the following control. For example, if there is an alternative with higher priority (e.g., another banknote storing cassette 21 of which the index value is within the allowable range), the alternative may be selected. If there is no such alternative, the banknotes are stacked in the former banknote storing cassette 21.

(#5)

In the above-described example, the description has been made on the premise that there is a single banknote storing cassette 21 corresponding to the banknotes of the recognized denomination. Alternatively, the process can be performed in the same manner even if there are two or more banknote storing cassettes 21 corresponding to the banknotes of the recognized denomination.

For example, if there are two or more banknote storing cassettes 21 corresponding to the banknotes of the recognized denomination, the controller 30 selects one of the banknote storing cassettes 21 based on the index value indicating the state of the banknotes stacked in each of the banknote storing cassettes 21. For example, one of the banknote storing cassettes 21, in which the difference between the numbers of banknotes of the first and second types TY1 and TY2 is less than the threshold value, may be selected. If there are two or more banknote storing cassettes 21 which permit the stacking of the banknotes, the controller 30 selects, for example, one of the banknote storing cassettes 21 of which the index value approaches a target value when the banknotes are stacked therein. In this example, the target value of the index value is zero, i.e., the intended state is N1=N2. Thus, if the banknotes are of the first type TY1, the banknote storing cassette 21 which satisfies N1<N2 is selected. If the banknotes are of the second type TY2, the banknote storing cassette 21 which satisfies N2<N1 is selected. As a result, the state of the banknotes stacked in each of the banknote storing cassettes 21 can be made more desirable.

How the controller 30 selects a suitable one from two or more banknote storing cassettes 21 which permit the stacking of the banknotes is not limited to the example described above. For example, based on the preset priority, the banknote storing cassette 21 in which the banknotes are to be stacked may be selected. The priority may be set based on, for example, the style or ID of the banknote storing cassette 21, or may be optionally set by a user. Alternatively, the banknote storing cassette 21 in which less banknotes are currently stored may be preferentially selected.

(#6)

In the above-described example, on condition that the banknotes have been stacked in the banknote storing cassette 21, the stacking information indicating the stacking order of the banknotes and to which of the first and second types TY1 and TY2 each banknote belongs is updated, and the count values are obtained from the stacking information. However, the present disclosure is not limited to this example. For example, the count values may be updated when it is determined to permit the stacking of the banknotes in the banknote storing cassette 21 (S18), or when it is determined not to permit the stacking of the banknotes in the banknote storing cassette 21 (S19), as shown in the flowchart of FIG. 6. Thus, the count value can be updated right after the passage of the banknote through the recognition unit 13. As a result, an index value for a next banknote that comes to the recognition unit 13 before the former banknote is stacked in the banknote storing cassette 21 can be evaluated using the updated count value. Further, if the apparatus is stopped due to an error occurred when the banknotes are being transported, the stacking information and the count value do not correspond with each other. In such a case, the banknotes being transported are all removed, and a correct count value is created based on the stacking information.

Other Embodiments

In the foregoing embodiment, it has been described how the control is performed for making the state of the banknotes stacked in the banknote storing cassette 21 (which is an example of a stacking unit) in the banknote handling apparatus 1 more desirable. Note that the control is applicable to other configurations.

For example, the control may be applied to a tape-winding storage module of the banknote handling apparatus 1, such as the escrow unit 14. If the stacked banknotes have an uneven thickness, the tape may be wound in the shape of a truncated cone, and the banknotes wound by the tape may fall off the tape-winding storage module. Such a problem can be avoided if the above-described control is applied to the tape-winding storage module regarded as the stacking unit.

Figure 8:
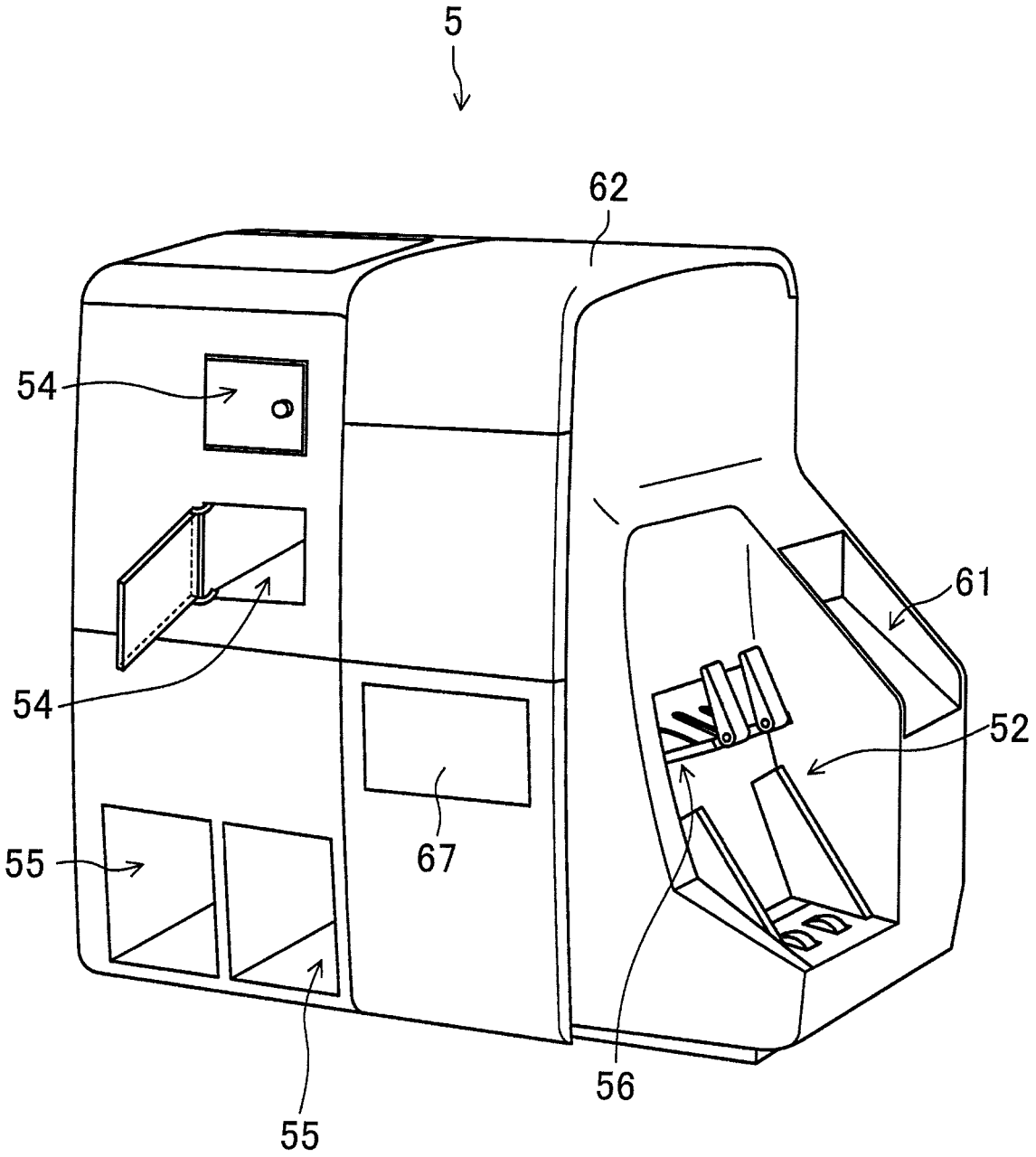
FIG. 8 is an external view illustrating another configuration of a paper sheet handling apparatus.

Moreover, the above-described control may also be applied to a paper sheet handling apparatus including a stacker which is open outside. FIG. 8 is an external view illustrating a banknote bundling apparatus 5 as an example of such a paper sheet handling apparatus. The banknote bundling apparatus 5 is placed on a teller counter of a bank, for example, and is used by an operator. The banknote bundling apparatus 5 takes loose banknotes therein, stacks banknotes of a predetermined denomination, bundles the stacked banknotes in a predetermined bundling number, and dispenses the bundled banknotes. The banknote bundling apparatus 5 includes an inlet unit 52 through which the banknotes placed thereon are taken in, a bundling stacker 54 in which banknotes to be bundled are stacked, non-bundling stackers 55 in which banknotes which are not to be bundled are stacked, a reject stacker 56 in which rejected banknotes are stacked, a dispense unit 61 through which the bundled banknotes are dispensed, and a touch panel 67. Although not shown, a housing 62 houses therein a recognition unit for recognizing the banknotes, a transport unit for transporting the banknotes taken in through the inlet unit 52 to the recognition unit, the bundling stacker 54, the non-bundling stackers 55, and the reject stacker 56, and a bundling unit which bundles the banknotes stacked in the bundling stacker 54.

If the banknotes stacked in the bundling stacker 54 have an uneven thickness, a bundling tape with which the banknotes are bundled in the bundling unit may easily be detached. For example, such a problem occurs when the banknotes having an uneven thickness are stacked in the same orientation. Application of the above-described control to the bundling stacker 54 regarded as the stacking unit can avoid easy detachment of the bundling tape.

A bundle of banknotes stacked in each non-bundling stacker 55 may proceed to a next step, i.e., may be deposited directly in the banknote handling apparatus, or may be used as banknotes to fill a banknote cassette to be attached to another banknote handling apparatus. If the banknotes stacked in the non-bundling stackers 55 have an uneven thickness, the depositing of the banknotes, or the feeding of the banknotes from the banknote cassette may fail. Alternatively, a bundle of banknotes stacked in the non-bundling stacker 55 may sometimes be bundled by hand. If these banknotes have an uneven thickness, a trouble may possibly occur during the bundling. For example, such problems occur when the banknotes having an uneven thickness are stacked in the same orientation. Application of the above-described control to the non-bundling stacker 55 regarded as the stacking unit can avoid these problems.

The disclosed paper sheet handling apparatus is not limited to an apparatus for handling paper sheets. The paper sheets to be handled or stacked may include checks, notes, and vouchers.

The paper sheets handled by the disclosed apparatus are not limited to those having the shape shown in FIG. 2. As long as the paper sheet does not have a uniform thickness, i.e., is thick at a portion and thin at the other portion, the above-described control can be applied to obtain the advantages disclosed above.

DESCRIPTION OF REFERENCE CHARACTERS

1 Banknote Handling Apparatus (Paper Sheet Handling Apparatus)
5 Banknote Bundling Apparatus (Paper Sheet Handling Apparatus)
11 Depositing Unit (Intake Unit)
12 Dispensing Unit (Discharge Unit)
13 Recognition Unit
14 Escrow Unit (Stacking Unit)
15 Transport Unit
21 Banknote Storing Cassette (Stacking Unit)
23 Collection Cassette (Keeping Unit)
24 Roller (Feeding Unit)
30 Controller
35 Information Output Unit
40 Memory Unit
52 Intake Unit
54 Bundling Stacker (Stacking Unit)
55 Non-Bundling Stacker (Stacking Unit)
100 Banknote

The invention claimed is:

1. A paper sheet handling apparatus, comprising:

an intake unit through which paper sheets are taken in one by one, the paper sheets having a protrusion protruding in a thickness direction of the paper sheet;

a transport unit which transports the paper sheets taken in through the intake unit;

a recognition unit which recognizes which of a face or back of each of the paper sheets being transported by the transport unit faces up and how each of the paper sheets being transported by the transport unit is oriented;

a stacking unit in which the paper sheets transported by the transport unit are stacked, with surfaces of an adjacent pair of the paper sheets being in contact with each other; and a controller which controls transport of the paper sheets to the stacking unit based on recognition information of the paper sheets, wherein the controller is configured to:

classify the paper sheets into a first type and a second type as a plurality of types that are different in thickness distribution based on a result of recognition by the recognition unit as to which of the face or back of the paper sheet faces up, and as to how the paper sheet is oriented, the first type being a type having the protrusion on a first side of the paper sheet and the second type being a type having the protrusion on a second side of the paper sheet, the first and second sides being opposite to each other in the direction;

and make a determination whether to permit the stacking of the paper sheets in the stacking unit based on the type to which the paper sheets recognized by the recognition unit belong, and the number of paper sheets of each type stacked in the stacking unit.

2. The paper sheet handling apparatus of claim 1, wherein the controller obtains an index value representing a state of the paper sheets stacked in the stacking unit based on the number of paper sheets of each type stacked in the stacking unit, and makes the determination based on the index value.

3. The paper sheet handling apparatus of claim 2, wherein the controller uses, as the index value, a difference between the number of paper sheets of the first type stacked in the stacking unit and the number of paper sheets of the second type stacked in the stacking unit.

4. The paper sheet handling apparatus of claim 3, wherein if the difference is equal to or greater than a predetermined value, the controller does not permit the paper sheets of the first type to be stacked in the stacking unit when a larger number of the paper sheets of the first type have been stacked in the stacking unit than the paper sheets of the second type.

5. The paper sheet handling apparatus of claim 2, wherein the stacking unit comprises a plurality of stacking units, and the controller selects, among the plurality of stacking units, at least one stacking unit which permits the stacking of the paper sheets therein based on the index value, and selects, if there are two or more stacking units which permit the stacking of the paper sheets therein, one of the two or more stacking units which allows the index value to approach a target value when the paper sheets transported by the transport unit are stacked therein.

6. The paper sheet handling apparatus of claim 1, further comprising:

a second stacking unit in which the paper sheets transported by the transport unit are stacked in alignment, with surfaces of an adjacent pair of the paper sheets being in contact with each other, wherein the controller controls the transport unit so that paper sheets which are not permitted to be stacked in the stacking unit are stacked in the second stacking unit.

7. The paper sheet handling apparatus of claim 1, further comprising:

a discharge unit which receives paper sheets that are not accepted by the paper sheet handling apparatus, wherein the controller controls the transport unit so that paper sheets which are not permitted to be stacked in the stacking unit are transported to the discharge unit.

8. The paper sheet handling apparatus of claim 1, further comprising:

a keeping unit which keeps the paper sheets, wherein the controller controls the transport unit so that paper sheets which are not permitted to be stacked in the stacking unit are transported to the keeping unit.

9. The paper sheet handling apparatus of claim 8, wherein the stacking unit includes a feeding unit, and the keeping unit includes no feeding unit.

10. The paper sheet handling apparatus of claim 1, further comprising:

a discharge unit which receives paper sheets that are not accepted by the paper sheet handling apparatus; and a keeping unit which keeps the paper sheets, wherein the controller controls the transport unit so that paper sheets which are not permitted to be stacked in the stacking unit are transported to the discharge unit or the keeping unit, and is able to switch a destination of the paper sheets between the discharge unit and the keeping unit.

11. The paper sheet handling apparatus of claim 1, wherein the controller instructs the intake unit to stop the taking of the paper sheets if the stacking of the paper sheets in the stacking unit is not permitted, or if the stacking of the paper sheets in the stacking unit is not permitted and a history of the determination satisfies a predetermined condition.

12. The paper sheet handling apparatus of claim 1, wherein the controller outputs to the outside of the paper sheet handling apparatus, via an information output unit, information which encourages a user to turn the paper sheets to be taken in through the intake unit over or change an orientation of the paper sheets if the stacking of the paper sheets in the stacking unit is not permitted, or if the stacking of the paper sheets in the stacking unit is not permitted and a history of the determination satisfies a predetermined condition.

13. The paper sheet handling apparatus of claim 1, further comprising:

a memory unit which stores stacking information indicating a stacking order of the paper sheets stacked in the stacking unit, and to which one of the plurality of types each of the paper sheets belongs.

14. The paper sheet handling apparatus of claim 13, wherein the stacking unit includes a feeding unit which feeds the paper sheets, and the controller updates the stacking information as the paper sheets are fed from the stacking unit.

15. A method for controlling transport of paper sheets to a stacking unit of a paper sheet handling apparatus, the paper sheets having a protrusion protruding in a thickness direction of the paper sheet, the stacking unit being configured to stack paper sheets, with surfaces of an adjacent pair of the paper sheets being in contact with each other, the method comprising:

allowing a transport unit to transport the paper sheets taken in the paper sheet handling apparatus;

allowing a recognition unit to recognize which of a face or back of each of the paper sheets being transported by the transport unit faces up, and how each of the paper sheets being transported by the transport unit is oriented;

classifying the paper sheets into a first type and a second type as a plurality of types that are different in thickness distribution based on a result of recognition by the recognition unit as to which of the face or back of the paper sheet faces up, and as to how the paper sheet is oriented, the first type being a type having the protrusion on a first side of the paper sheet and the second type being a type having the protrusion on a second side of the paper sheet, the first and second sides being opposite to each other in the direction;

making a determination whether to permit the stacking of the paper sheets in the stacking unit based on the type to which the paper sheets recognized by the recognition unit belong, and a number of paper sheets of each type stacked in the stacking unit.

16. A paper sheet handling apparatus, comprising:

an intake unit through which paper sheets are taken in one by one, the paper sheets having a protrusion protruding in a thickness direction of the paper sheet;

a transport unit which transports the paper sheets taken in through the intake unit;

a recognition unit which recognizes a denomination of each of the paper sheets, which of a face or back of each of the paper sheets being transported by the transport unit faces up and how each of the paper sheets being transported by the transport unit is oriented;

a plurality of stacking units in which the paper sheets transported by the transport unit are stacked, with surfaces of an adjacent pair of the paper sheets being in contact with each other, each of the plurality of stacking units stacking the paper sheets for different denominations; and a controller which controls transport of the paper sheets to the stacking unit based on recognition information of the paper sheets, wherein the controller is configured to:

classify the paper sheets with a specified denomination into a plurality of types that are different in thickness distribution based on a result of recognition by the recognition unit as to the denomination of paper sheets, which of the face or back of the paper sheet faces up, and how the paper sheet is oriented; and make a determination whether to permit the stacking of the paper sheets with the specified denomination in a first stacking unit, the first stacking unit being a single one of the plurality of stacking units for the specified denomination, based on the type to which the paper sheets with the specified denomination belong, and a number of paper sheets with the specified denomination of each type stacked in the first stacking unit.

* * * * *